US006000980A

United States Patent [19]

Baldi et al.

[11] Patent Number: 6,000,980

[45] Date of Patent: Dec. 14, 1999

[54] PROCESS FOR FABRICATING A MICROTIP CATHODE ASSEMBLY FOR A FIELD EMISSION DISPLAY PANEL

[75] Inventors: Livio Baldi, Agrate Brianza; Alessandro Tonti, Monza, both of Italy

[73] Assignee: SGS-Thomson Microelectronics S.r.l., Agrate Brianza, Italy

[21] Appl. No.: 08/807,113

[22] Filed: Dec. 13, 1996

[30] Foreign Application Priority Data

Dec. 14, 1995 [EP] European Pat. Off. ..... 95830520

[51] Int. Cl.[6] ..... H01J 9/02

[52] U.S. Cl. ..... 445/24

[58] Field of Search ..... 445/24, 50, 49

[56] References Cited

U.S. PATENT DOCUMENTS 5,739,628 4/1998 Takada ..... 313/309

*Primary Examiner*—Kenneth J. Ramsey

*Attorney, Agent, or Firm*—Allen, Dyer, Doppelt, Milbrath & Gilchrist, P.A.

[57] ABSTRACT

A process for forming a microtip cathode structure on a field emission display panel which avoids the need of vacuum depositing a lift-off layer for the microtip deposition over-structure in specially equipped reactors to accomplish a deposition at a grazing angle, by co-patterening the lift-off layer together with an underlying metal grid layer using a succession of different etching steps through the openings of a grid definition mask. According to an embodiment, nickel is used as lift-off material and is either wet-etched or sputter-etched before performing a plasma etch of the underlying grid metal layer. According to an alternative embodiment, the masking resist layer is used as lift-off material.

39 Claims, 6 Drawing Sheets

FED DISPLAY FUNCTIONAL BLOCK DIAGRAM

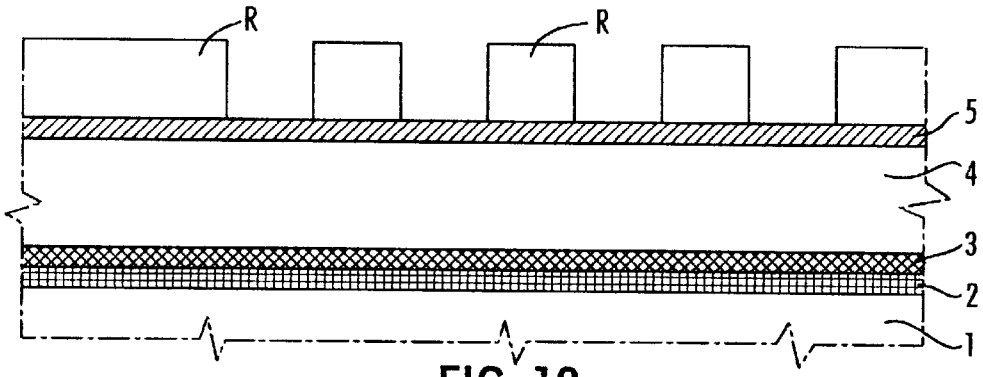
FIG. 12
FIG. 13
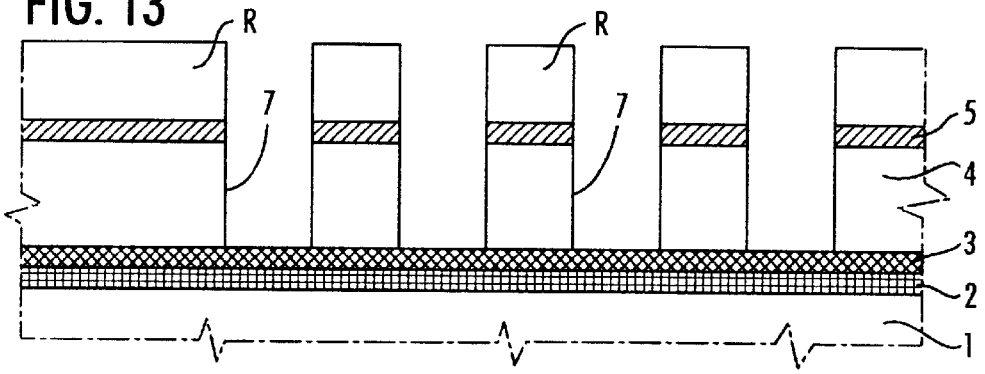
FIG. 14
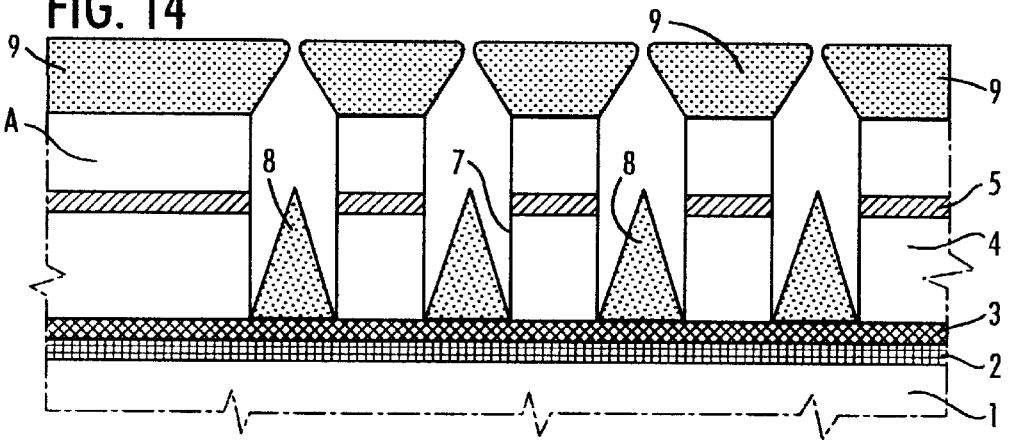
FIG. 15
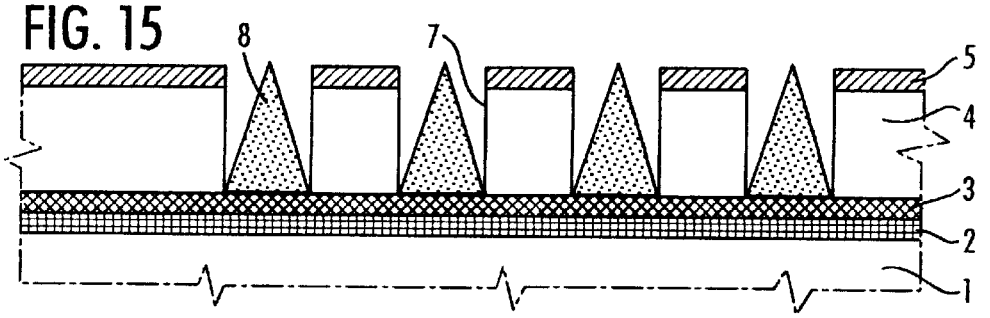

PROCESS FOR FABRICATING A MICROTIP CATHODE ASSEMBLY FOR A FIELD EMISSION DISPLAY PANEL

CROSS-REFERENCE TO RELATED APPLICATION

This application claims priority from EP 95830520.3, filed Dec. 14, 1995, which is hereby incorporated by reference. However, the content of the present application is not necessarily identical to that of the priority application.

BACKGROUND AND SUMMARY OF THE INVENTION

This invention relates to a device for limiting and making uniform the current through microtips of a cathodic structure for flat panel displays (FPD) of the field emission type (FED). More in particular, the process of the invention relates to the formation of microtips of a refractory metal by sputtering in preformed wells and removing the deposition overstructure.

The continuous evolution towards portable electronic products such as laptop computers, personal organizers, pocket TVs and electronics games, has created an enormous market for monochromatic or color display screens of small dimensions and reduced thickness, having a light weight and a low dissipation. The first two requirements of small dimensions and reduced thickness cannot be met by conventional cathode ray tubes (CRT). For this reason, among the emerging technologies, in addition to those related to liquid-crystal-displays (LCD), flat panel field emission display technology has been receiving increased attention by the industry.

Over the past few decades, remarkable research and development work has been carried out on field emission displays (FED) employing a cathode in the form of a flat panel provided with a dense population of emitting microtips co-operating with a grid-like extractor essentially coplanar to the apexes of the microtips. The cathode-grid extractor structure is a source of electrons that are accelerable in a space, evacuated for ensuring an adequate mean free-path, towards a collector (anode) constituted by a thin and transparent conductor film upon which are placed luminescent phosphors excited by the impinging electrons. Emission of electrons is modulately excitable pixel by pixel through a matrix of columns and rows, constituted by parallel strips of the population of microtips and parallel strips of the grid-like extractor, respectively. The fundamental structure of these display systems, the main problems related to the fabrication technology, including reliability, durability, and those concerning the peculiar way of exciting individual pixels of the display system, and the various proposed solutions to these problems, are discussed and described in a wealth of publications on these topics. Among the pertinent literature, the following publications may be cited and are hereby incorporated by reference:

U.S. Pat. No. 5,391,259; Cathey, et al.
U.S. Pat. No. 5,387,844; Browning
U.S. Pat. No. 5,357,172; Lee, et al.
U.S. Pat. No. 5,210,472; Casper, et al.
U.S. Pat. No. 5,194,780; Meyer
U.S. Pat. No. 5,064,396; Spindt
U.S. Pat. No. 4,940,916; Borel, et al.
U.S. Pat. No. 4,857,161; Borel, et al.
U.S. Pat. No. 3,875,442; Wasa, et al.
U.S. Pat. No. 3,812,559; Spindt, et al.
U.S. Pat. No. 3,755,704; Spindt, et al.

U.S. Pat. No. 3,655,241; Spindt, et al.

"Beyond AMLCDs: Field emission displays?", K. Derbyshire, Solid State Technology, November 1994;

"The state of the Display", F. Dawson, Digital Media, February–March 1994;

"Competitive Display Technologies", 1993, Stanford Resources, Inc.;

"Field-Emission Display Resolution", W. D. Kesling, et al., University of California, SID 93 DIGEST 599–602;

"Phosphors For Full-Color Microtips Fluorescent Displays", F. Levy, R. Meyer, LETI—DOFT—SCMM, IEEE 1991, pages 20–23;

"Diamond-based field emission flat panel displays", N. Kumar, H. Schmidt, Solid State Technology, May 1995, pages 71–74;

"Electron Field Emission from Amorphic Diamond Thin Films", Chenggang Xle, et al., Microelectronics and Computer Technology Corporation, Austin, Tex.; University of Texas and Dallas, Richardson, Tex.; SI Diamond Technology, Inc., Houston, Tex.;

"Field Emission Displays Based on Diamond Thin Films", Natin Kumar, et al:, Microelectronics and Computer Technology Corporation, Austin, Tex.; Elliot Schlam Associates, Wayside, N.J.; SI Diamond Technology, Inc., Houston, Tex.;

"U.S. Display Industry on the Edge", Ken Werner, Contributing Editor, IEEE Spectrum, May 1995;

"FEDs: The sound of silence in Japan", OEM Magazine, April 1995, pages 49, 51;

"New Structure Si Field Emitter Arrays with low Operation Voltage", K. Koga, et al., 2.1.1, IEDM 94–23.

The major advantages of FEDs compared to modern LCDs include:

low dissipation;

same color quality of traditional CRTs; and visibility from any viewing angle.

FED technology has been developed on the basic teachings contained in U.S. Pat. Nos. 3,665,241; 3,755,704 and 3,812,559 of C. A. Spindt and in U.S. Pat. No. 3,875,442 of K. Wasa, et al. FED technology connects back to conventional CRT technology, in the sense that light emission occurs because of the excitation of the phosphors deposited on a metallized glass screen, which is bombarded by electrons accelerated in an evacuated space. The main difference is the manner in which electrons are emitted and the image is scanned.

A concise but thorough account of the state of modern FED technology is included in a publication entitled "Competitive Display Technologies—Flat Information Displays" by Stanford Resources. Inc., Chapter B "Cold Cathode Field Emission Displays". A schematic illustration contained in that publication which gives a comparison between a conventional CRT display and a FED (or FED array) is reproduced in FIG. 1. In a traditional CRT, a single cathode 100 in the form of an electron gun 110 (or a single cathode for each color) is provided and magnetic or electrostatic yokes 120 deflect the electron beam for repeatedly scanning the screen 130, whereas in a FED, the emitting cathode 150 is constituted by a dense population of emission sites 160 distributed more or less uniformly over the display area. Each site is constituted by a microtip 170 electrically excitable by means of a grid-like extractor 180. This flat cathode-grid assembly is set parallel to the screen 190, at a relatively short distance from it. The scanning by pixel of the display is performed by sequentially exciting individually addressable groups of microtips 170 by biasing them with an adequate combination of grids and cathode voltages.

As shown in FIG. 2, a certain area of the cathode-grid structure containing a plurality of microtips and corresponding to a pixel of the display is sequentially addressed through a driving matrix organized in rows and columns (in the form of sequentially biasable strips, into which the cathode is electrically divided and of sequentially biasable strips into which the grid extractor is electrically divided, respectively).

A typical scheme for driving a pixel of the cathodic structure of a FED is shown in FIG. 3. This figure illustrates the driving scheme of a fragment of nine adjacent pixels through a combination of the sequential row biasing pulses for the three rows R1, R2, R3, relative to a certain bias configuration of the three columns C1, C2 and C3.

A typical cross-sectional view of a FED structure is shown in FIG. 4. The microtip cathode plate generally comprises a substrate of an isolating material such as glass, ceramic, or silicon 400, onto which is deposited a low resistivity conductor layer 410, for example, a film of aluminum, niobium, nickel, or a metal alloy, eventually interposing an adhesion layer of, for example, silicon 420 between the substrate 400 and the conductor layer 410.

The conductor layer 410 is photolithographically patterned into an array of parallel strips each constituting a column of a driving matrix of the display. A dielectric layer 430, for example, an oxide, is deposited over the patterned conductor layer 410. Another conductor layer 440, from which the grid extractor will be patterned, is deposited over the dielectric layer 430.

The grid structure is eventually defined in parallel strips, normal to the cathode parallel strips 410. According to a known technique, micro-apertures or wells that reach down to the surface of the under-lying patterned conductor layer 410 are defined and cut through the grid conductor layer 440 and through the underlying dielectric layer 430. Onto the surface of the conductor layer exposed at the bottom of the "wells", are fabricated microtips 450 that constitute the many sites of emission of electrons.

On the inner face of a glass faceplate 460 of the display is deposited a transparent thin conducting film 470, for example, a mixed oxide of indium and tin upon which is deposited a layer of phosphors 480 (monochromatic phosphor or color phosphors) excitable by the electrons accelerated toward the conducting layer 470 and acting as a collector of the electrons emitted by the microtips 450. Emission is stimulated by the electric field produced by suitably biasing the grid conductor 440 and the cathode tips 450.

In order to improve color resolution, the realization of a "switched" anodic (collector) structure for separately biasing adjacent strips, each covered with a phosphor of a different basic color, has been suggested in a publication entitled: "Phosphors For Full-Color Microtips Fluorescent Displays" by F. Lévy and R. Mayer, LETI-DOFT-SCMM, Grenoble-Cedex-France.

According to a known process for fabricating the cathodic structure of a FED, after completing the formation of the grid of niobium, or of any other self-passivating metal, and employing the etching solutions normally used in the fabricating process, a lift-off layer is deposited on the grid. This lift-off layer is generally constituted by a metal that is easily and selectively wet-etchable through its exposed edges so to allow the removal (lift-off) of the cone deposition overstructure. This deposition process is carried out by sputtering at a normal incidence with the panel surface, a metal (usually a refractory metal such as molybdenum) that is also capable of resisting the etch conditions during the lift-off to form deposition cones within the wells that have been formed through the grid openings layer and an underlying dielectric layer.

The bottom of the deposition wells of the cones is constituted by a substantially conductive layer and, more preferably, by a special conductive layer purposely having a high resistivity, superimposed to the highly conductive material of the selectable cathodic conductors or strips.

Prevention of lift-off material deposition inside the wells is of paramount importance.

At present, this critical requisite of the fabrication process is fulfilled by using deposition techniques of the lift-off layer that avert deposition onto the bottom of the wells. Commonly, a lift-off layer of nickel is deposited by vacuum evaporation, while maintaining an extremely small angle of incidence of the impinging nickel (i.e. at grazing angle). Of course, the panel under fabrication must be rotated around its own axis while maintaining a minimum angle of incidence with respect to the impinging flow so as to obtain a deposition of uniform thickness. This requires the presence of complex and inevitably encumbering organs for rotating the panel in the vacuum deposition chamber, considering that the panels can reach dimensions of 27×36 cm. All of this increases the costs of fabrication of these panels. The criticality of this stage of the fabrication process also has negative repercussions on production yields.

Confronted with this state of the art technique, an improved fabricating procedure that substantially obviates the above-mentioned critical aspects of well known processes embodies the present invention. The process of preferred embodiments of the invention does not require the use of special grazing-angle-deposition devices, and reduces the manufacturing costs while improving the yield.

Basically, the preferred process of the invention, different from well known processes, does not contemplate a complete pre-definition of the grid structure, rather a corrosion-resisting metallic material, from which the grid structure will be defined, is deposited onto a matrix layer. In addition, a layer of a lift-off material that can be easily and selectively etched is deposited prior to forming the grid apertures and the corresponding wells, inside which the cathodic microtips will be eventually formed.

The lift-off material can be the same masking resist or, if of another type of material, such a layer is contextually defined with the grid matrix layer and the underlying isolation dielectric layer during the etching that is performed to form the grid apertures angle and the corresponding wells.

According to a first embodiment of the invention, a lift-off layer constituted by a thin layer of nickel or of another easily dissolvable metal can be used. The lift-off layer can be deposited by vacuum evaporation or sputtering at a normal incidence directly onto the surface of a grid metal matrix (still unpatterned) layer whose thickness is generally greater than the thickness of the lift-off layer. The grid matrix layer can be, for example, niobium, tungsten, chromium, or tantalum, or alloys or stacked layers thereof deposited by vacuum evaporation, or it can be an adequately doped polycrystalline or amorphous silicon.

Parallel strips orthogonal to the cathodic conductors can optionally be predefined before depositing of the nickel or similar lift-off material. Subsequently, circular apertures with a diameter of about 1.0–1.5 micrometers, densely and uniformly distributed over the surface of each strip, are thereafter defined through a masking step.

The etching of the stack through the apertures of the resist mask, that comprises the thin lift-off layer of nickel or similar metal, the grid matrix layer of corrosion resistant metal, and the underlying dielectric layer, typically of silicon oxide, can be conducted in different phases.

The known difficulty of dry-etching (i.e. plasma etching) of the nickel, consisting of the formation of non-volatile nickel compounds is overcome by resorting to an ion-milling technique or the like. The etching of the thin top layer of nickel or similar metal through the apertures of the mask can be carried out by a sputter etch with Argon ions. Nickel is the preferred metal due to the fact that it shows a relatively high yield to sputtering.

The possibility of carrying out a "sputter etch" in an Argon plasma is generally offered by standard deposition plasma reactors. This feature is normally available for allowing the removal of possible superficial (native) oxide layers before starting the vacuum deposition. However, this feature may be easily included in other common apparatuses, such as in the same R.I.E. reactor that is used for eventually etching the grid matrix layer and the underlying isolating oxide. For example, the R.I.E. Precision 5000 or Centura models, both by Applied Materials Corporation, can be easily equipped to permit the carrying out of an Argon sputter etch.

In the above-identified R.I.E. etcher, a preliminary Argon sputter etch phase can be carried out with a power of 300 W (corresponding to a plasma voltage of about 500V). The removal of a thin lift-off layer of nickel, whose thickness is typically on the order of 15–20 nanometers (nm), would require a treatment of about two to three minutes. In a case such as this, it is convenient to use, as a grid matrix material, a doped polycrystalline or amorphous silicon layer or a tungsten layer, because both of these materials are characterized by a sputter yield markedly lower than that of nickel. Therefore, they provide for advantageous conditions for implementing an automatic stop of the sputter etching of the nickel layer, according to well known techniques.

The anisotropic plasma etching of the grid matrix layer (for example, polycrystalline silicon, tungsten, or niobium) and the subsequent etching of the underlying oxide or similar dielectric layer that isolates the cathodic structure from the grid, can be carried out in sequence by the same etcher, using different chambers thereof, with different plasma compositions, specifically suited for the progression of the etching through the different materials that make up the "stack" to be etched, until the surface of the high resistivity layer (for example, doped polycrystalline silicon), of the cathodic structure is exposed.

Alternatively, the lift-off layer of nickel can be preliminarily etched through the masking apertures, by carrying out a wet-etching step in an appropriate etching solution, for example, a solution of hydrochloric acid, in a controlled manner so as to avoid overetching the nickel layer underneath the edges of the resist mask. The two types of etchings can be alternated in order to ensure a complete removal of the nickel from the unmasked areas without undercutting the nickel under the mask.

After completing the etching through the stack and removing the resist mask, a suitable refractory and etch-resistant metal, for example molybdenum, is deposited by "vertical" or "quasi-vertical" sputtering, according to a common technique. This phase of construction of the microtips comprises a plurality of steps. For example, it can comprise a first stage during which a thin film (in the order of some hundreds of Angstroms) of an adhesion (for example, chromium, tantalum or similar material) material having a relatively good crystallographic affinity with the base material, typically a high resistivity doped polycrystalline silicon layer, is deposited. Obviously, several layers of different materials can be deposited prior to a final deposition step.

During the last deposition step, the shielding effect of the walls of the preformed wells determines the formation of cones of deposition inside the wells, whose sharp vertex approximately reaches the level of the grid before an eventual occlusion of the deposition window in the deposited overstructure that grows over the lift-off layer.

Through an electrochemical etching of the lift-off layer, left exposed at the rims of the wells, the deposited overstructure of molybdenum is removed (lifted-off), thus leaving the deposition cones inside the wells cut through the isolating dielectric layer in correspondence with the grid openings.

The dissolution of the lift-off layer is accelerated by anodically biasing the nickel in an acid bath, commonly with a pH ranging between 2.5 and 3.

The lift-off etching of the nickel layer can be performed in an aqueous bath containing ammonium chloride, nickel chloride and boric acid and using a biasing counterelectrode (cathode) of nickel. The anodic biasing of the lift-off nickel layer can be arranged by contacting the front of the panel, that is, the deposited conductive overstructure. In this lift-off step of the deposition overstructure of molybdenum or of a stack of superimposed etch-resistant-metals through an anodic dissolution of the underlying nickel layer, the FED panel preformed cathodic structure is suitably left floating to prevent any possibility of corrosion of metallic components of the cathodic structure, and in particular, of the microtips themselves. Moreover, the relative corrosion resistance of the molybdenum tips and of the tungsten and/or niobium grid, is also ensured by a lower electronegativity of these metals as compared to that of nickel, and by the ability of these so-called valve metals to passivate themselves under anodic polarization conditions, thus impeding any further flow of corrosion current.

Similar wet etch resistance properties are also possessed by the polycrystalline silicon of the bottom layer of the wells onto which the cones of deposition are grown. By contrast, the end edges of the cathodic conductors, when they are realized with an easily corrodible metal such as nickel, must be appropriately protected during the lift-off wet-etching step. Obviously, if the cathodic conductors are made of a non-corrodible material, such as mixed indium and tin oxides, these precautions will not be necessary.

According to a preferred embodiment of the invention, and prior to depositing a thin lift-off layer (for example, nickel), the grid matrix layer (for instance, a doped polycrystalline or amorphous silicon, tungsten, chromium or niobium), can be patterned in parallel strips, orthogonally oriented to the cathodic conductors through a first masking and etching step. In this first patterning step of the grid structure in the form of a plurality of parallel strips, the etching is not continued through the underlying dielectric.

By performing such a preliminary patterning in parallel strips of the grid structure, prior to defining the wells into which the cones will be formed, "steps" are produced that interrupt the continuity of the grid matrix layer along a direction orthogonal to the orientation of the strips into which the grid is subdivided. This advantageously increases the number and extension of the exposed edges of the lift-off layer, which has a thickness lower than the patterned strips of the grid matrix layer, through which electrochemical etching will occur. In this way, the lift-off etching can proceed more rapidly and uniformly throughout the panel.

According to an alternative embodiment, the lift-off layer may be constituted by the residual layer of masking resist employed for defining the grid apertures during the etching of the grid conductor layer and of the underlying dielectric.

According to this embodiment, a first patterning step using an appropriate resist and a successive anisotropic etching, for example by R.I.E., defines circular apertures of a diameter ranging approximately between 1.0–1.5 micrometers, densely distributed over the surface of the grid matrix layer. These circular apertures (holes or wells) are formed through each grid strip and through the underlying dielectric layer, typically silicon oxide, until reaching the surface of a high resistivity layer, for example, doped polycrystalline silicon, for limiting the emission current through the microtips.

Without removing the residual resist layer of the mask, a suitable etch-resistant and refractory metal such as molybdenum is deposited via "vertical" or "quasi vertical" sputtering, according to a standard technique. The shielding effect of the walls of the preformed wells determines the growth of deposition cones in the wells whose sharp-pointed vertexes reach approximately the level of the grid layer before an eventual occlusion of the corresponding deposition window through the overstructure that grows above the resist layer.

By using a resist particularly resistant to high temperature and eventually hardened after development by exposure to UV radiation and/or heat (for example, the same type of resist commonly used for shielding drain and source implantations for defining the grid apertures and the corresponding wells), the resist mask layer that remains at the completion of the anisotropic plasma etching of the grid apertures and of the corresponding wells can be used as a lift-off layer for removing the deposition overstructure of the conductive cones grown by sputtering.

The deposition overstructure is lifted-off by etching this residual layer of masking resist in an oxygen plasma, which can precede or follow a wet-softening of the resist with, for example, organic strippers, such as EKC265, that are composed of chemically activated organic solvents having a medium boiling temperature.

The definition of the grid into parallel strips orthogonal to the cathodic conductors can take place in a quite customary manner, through a distinct masking step.

In either one of the above described embodiments of the invention, carrying out depositions at a "grazing" angle of incidence requiring the use of special devices to ensure an acceptable uniformity of the deposit is avoided. Moreover, any accidental deposition of lift-off material inside (on the bottom) of preformed wells is positively prevented, thus eliminating the consequent critical aspects of the known processes.

BRIEF DESCRIPTION OF THE DRAWING

The disclosed inventions will be described with reference to the accompanying drawings, which show important sample embodiments of the invention and which are incorporated in the specification hereof by reference, wherein:

FIGS. 12 to 15 illustrate an alternative embodiment of the process of the invention.

DETAILED DESCRIPTION OF THE PREFERRED EMBODIMENTS

Figure 1:
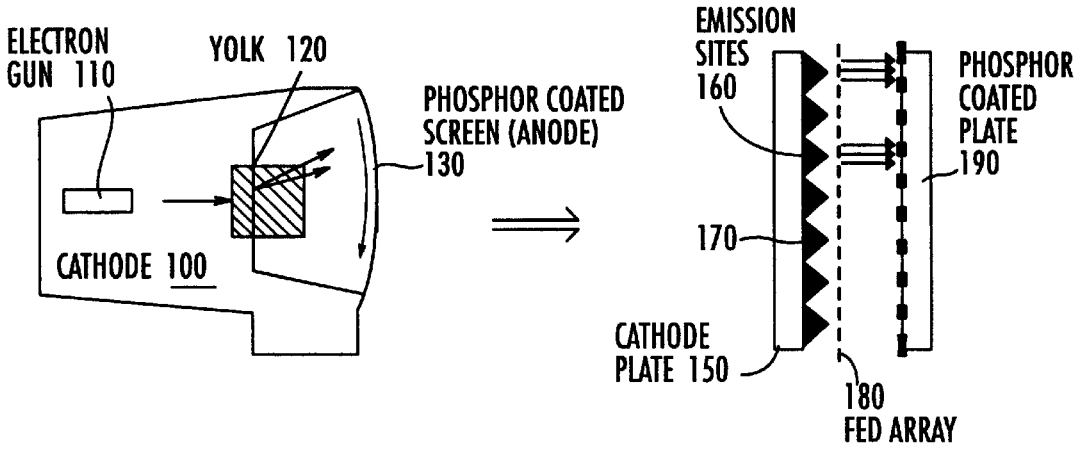
FIG. 1 is a comparative scheme of a conventional CRT display device) and a FED.
Figure 2:
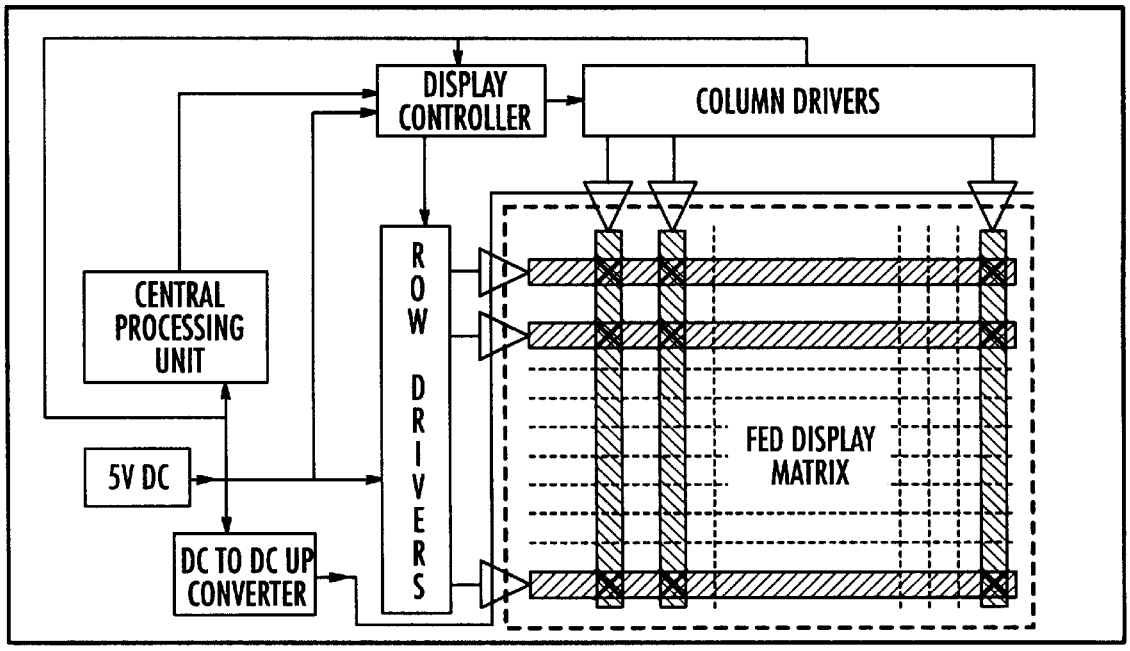
FIG. 2 shows in a schematic way the general architecture of a FED panel and of the respective driving circuit.
Figure 3:
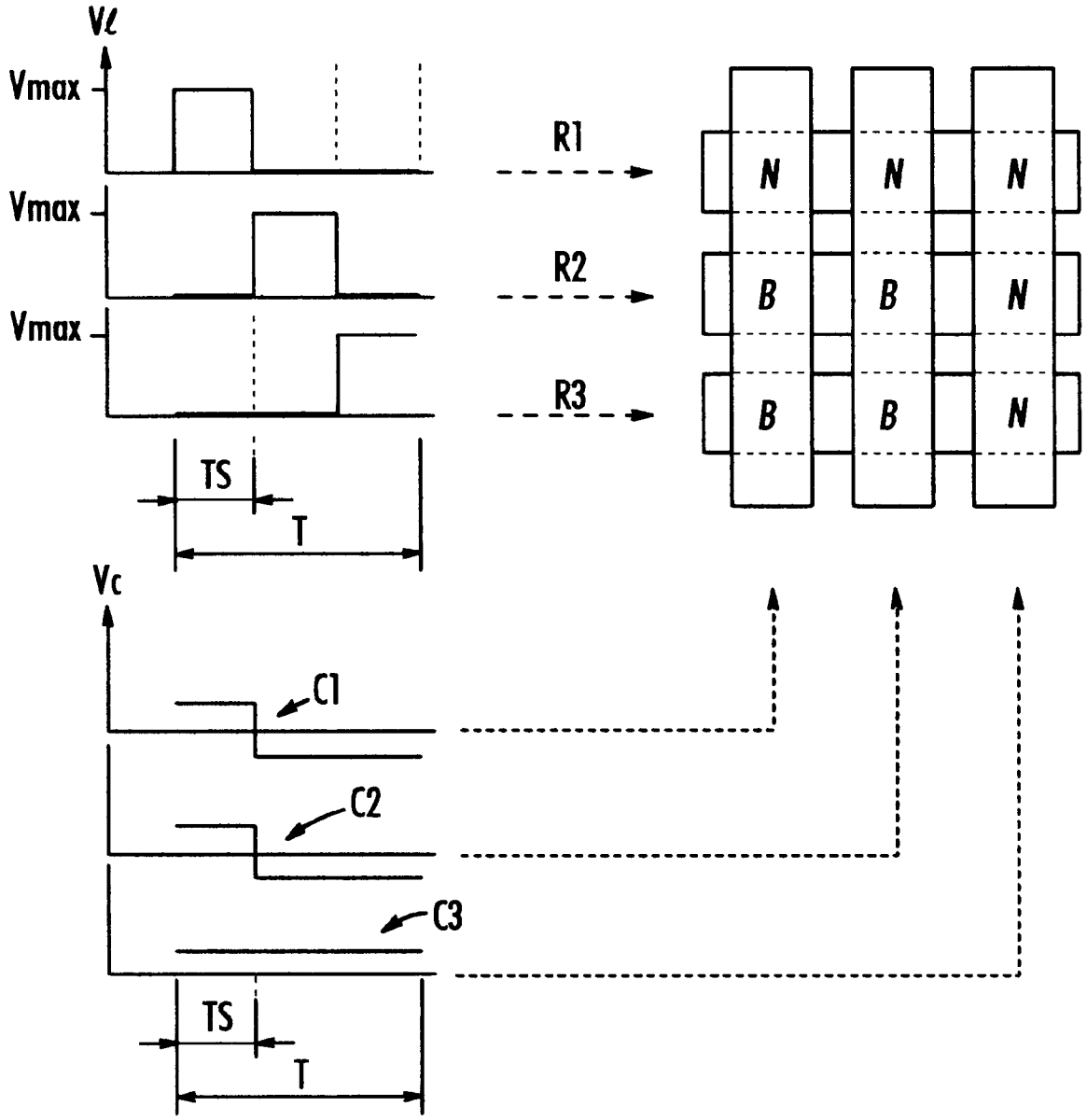
FIG. 3 is a schematic representation of a pixel driving mode in a FED.
Figure 4:
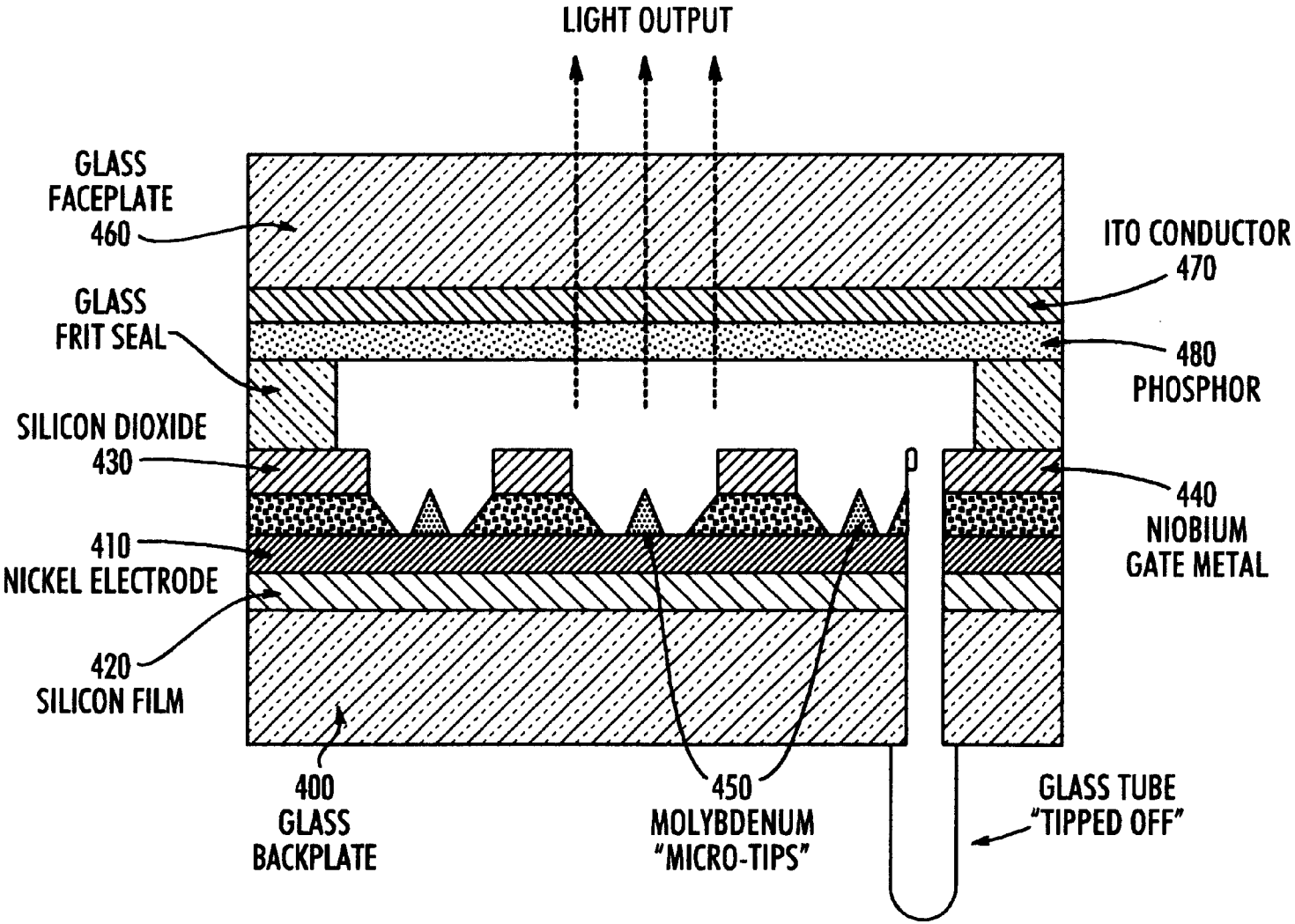
FIG. 4 is a schematic cross-section of a FED panel.

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

With reference to FIGS. 5 to 11 and 12 to 15, parallel conductive strips 2 constituting the cathodic conductors of the driving matrix by pixel of the panel are defined on a support plate of the dielectric material 1, typically a ceramic or a glass plate.

In the case of relatively large panels, the cathodic conductors 2 can be patterned from a matrix layer, such as nickel, and deposited by vacuum evaporation directly onto the face of the substrate 1, or after interposition of an adhesion layer, such as silicon oxide (not shown in the figures). In place of the nickel, it is possible to use other materials of sufficient conductivity, including nonmetals preferably having a good corrosion resistance, for example, a conductive mixed oxide of indium and tin (I.T.O.). The I.T.O. is a particularly preferred material in the case of screens of medium and small dimensions or particular uses, such as video cameras, oculars, etc.

Preferably, according to a well known technique, a second layer of a high resistivity material 3, for example, polycrystalline silicon adequately doped, is deposited over the conductor layer 2. This second layer has the function of introducing an imitating resistance of the current emitted through a selectably excited pixel.

The high resistivity layer 3, may be patterned together with the matrix layer 2 of the cathodic conductors by the same masking step. Above the cathodic conductors defined on the face of the panel substrate 1, an isolating dielectric layer 4, for example of silicon dioxide with a thickness varying between 0.6 and 1.3 micrometers, depending on the panel characteristics, is chemically deposited by a vapor phase.

Over the isolating layer 4 a conductive matrix layer of the grid 5 is deposited. The conductor material used for constituting the grid matrix layer must possess an appropriate crystallographic affinity with the material of the dielectric layer 4 to ensure a satisfactory adhesion, mechanic stability, and a sufficient chemical resistance to the etching solutions used for removing the lift-off material employed in the fabrication of the panel. Preferably, the grid matrix layer 5 is of a refractory and passivable metal such as niobium, tantalum, tungsten or similar metal, or may be of amorphous and/or polycrystalline silicon, adequately doped to reach a sufficient electric conductivity, or even of a multilayer of different conductor materials, though it is essential that the material be corrosion-resistant to the lift-off etchants.

The grid matrix layer 5, depending on its nature, can be deposited by vacuum evaporation or according to any other suitable method and can preferably have a thickness of about 0.5 $\mu$m, and more generally have a thickness ranging between 0.2 and 0.7 $\mu$m.

Preferably, the lift-off layer that is defined during the same definition step of the grid apertures, may be a thin sputtered layer of nickel.

According to a preferred embodiment, illustrated in the set of FIGS. 5 to 11, prior to depositing the lift-off layer, a predefinition of the grid matrix metal layer 5 into a plurality of parallel strips, orthogonal to the cathodic conductors 2 (and 3), is performed to improve the etching conditions during the lift-off step.

Figure 5:
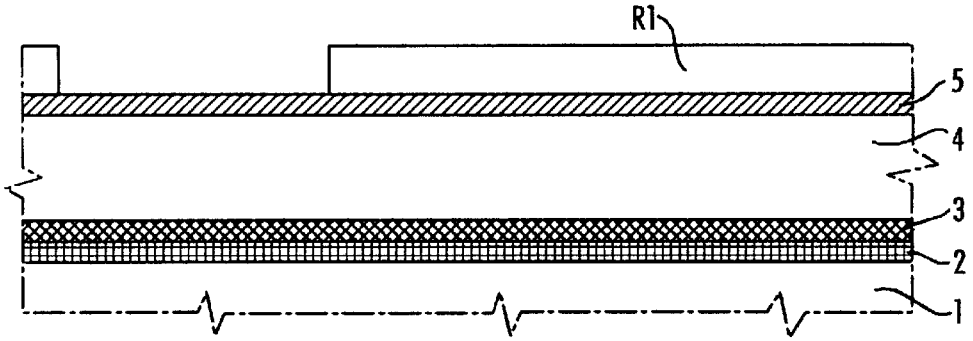
FIGS. 5 to 11 illustrate a first embodiment of the process of the invention.

As shown in FIG. 5, after completing the deposition of the grid matrix layer 5, a definition mask R1 of the grid strips is formed. The matrix layer 5 is etched through the aperture of this mask, forming parallel strips 5*a* and 5*b* which are orthogonal to the strips constituting the cathodic conductors 2 (and 3).

Figure 6:
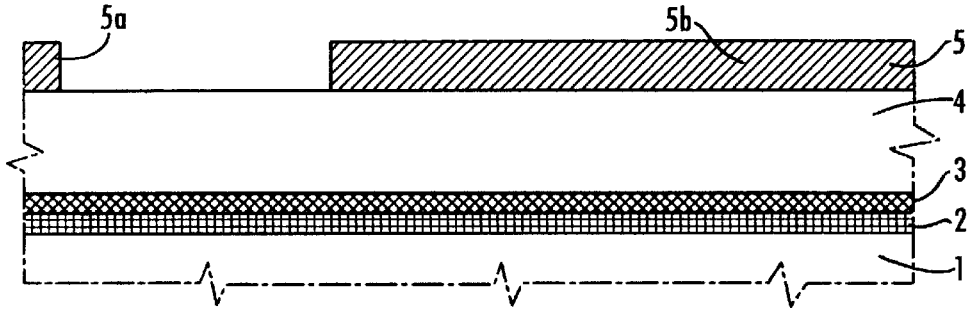
Figure 7:
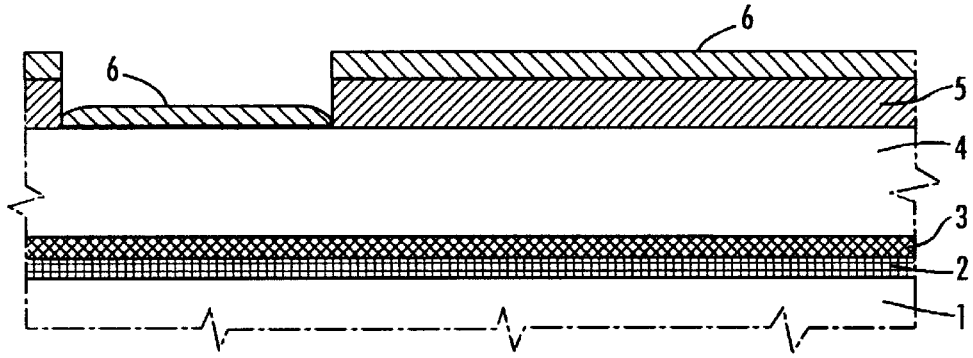

As noted, in this predefinition phase of the grid, the etching stops on the dielectric layer 4, without cutting through the dielectric, as shown in FIG. 6.

At this point, a thin layer of nickel 6 or of any other material easily wet-etchable chemically and/or electrolytically, is deposited. In the preferred case of using nickel as lift-off material, the layer 6, deposited by sputtering, may have a thickness generally ranging between 15 and 20 nm. In any case, it is essential that the thickness of the lift-off layer 6 deposited during this phase of the process be substantially smaller than the thickness of the grid matrix layer 5, already defined in parallel strips. This with the aim of creating lines of discontinuity of the liftoff layer 6 in coincidence with the definition steps of the parallel strips 5*a* and 5*b* of the grid matrix layer 5. This is highlighted in FIG. 7.

Figure 8:
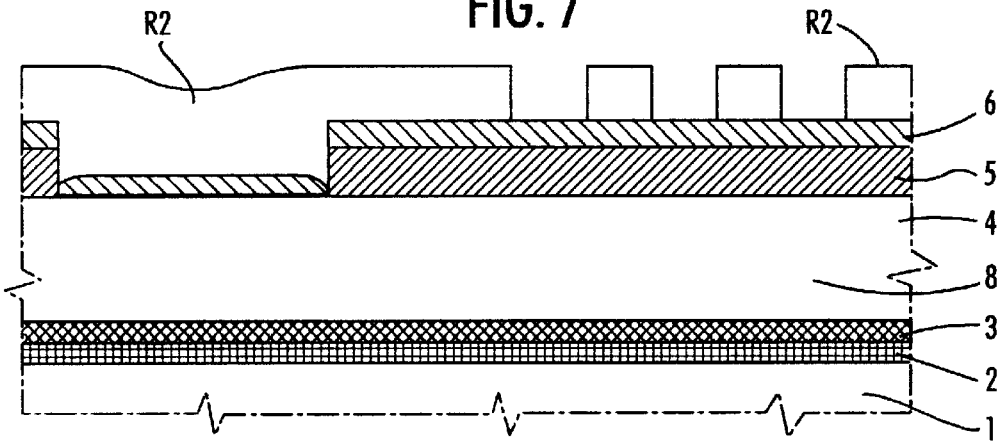
Figure 9:
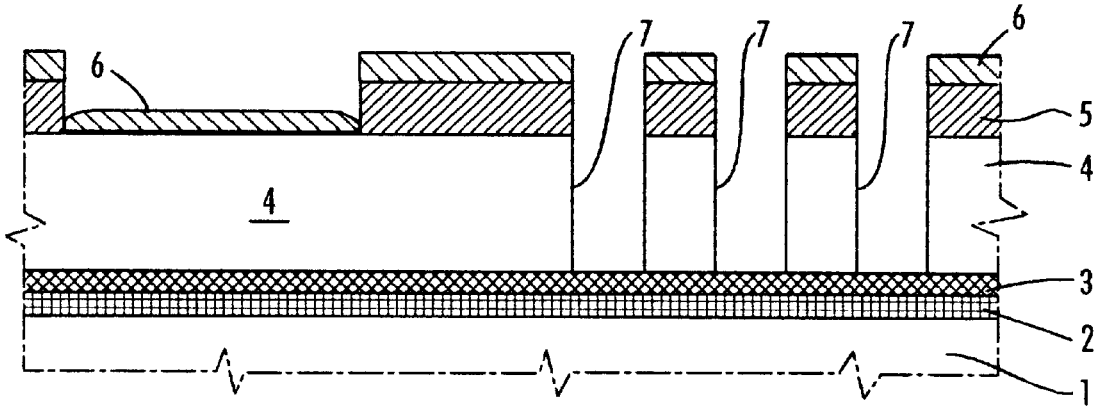

Referring to FIG. 8, a second definition mask R2 of the grid openings is formed, and through the apertures of this mask R2, a substantially anisotropic etching, of the multilayer composed by the lift-off layer of nickel 6, the grid matrix layer 5 (for example of doped polycrystalline silicon), and the dielectric layer 4 (for example of silicon oxide), is carried out, until exposing the surface of the high resistivity layer 3 of doped polycrystalline silicon, as shown in FIG. 9.

The known difficulty of dry-etching the nickel (in plasma) because of the formation of nonvolatile compounds, is overcome by submitting the panel to a process of ion-milling by way of a sputter etch with Argon for removing the nickel, as already described above. Alternatively, the top layer of nickel can be leached off by wet-etching, under controlled conditions, so as to prevent or limit any undue progress of etching under the edge of the masking resist.

Once the removal of the nickel layer 6 is completed, the underlying grid matrix layer (for example of niobium or tungsten), can be plasma etched through a common R.I.E. technique, using a $Cl_2$+He+$O_2$ plasma or any other suitable plasma composition. The R.I.E. plasma etching can continue through the isolating oxide layer 4, using a $CF_4$ or a $CHF_3$ mixture in Argon under a vacuum of about 170 mT.

If a doped polycrystalline or amorphous silicon is used as the conductor material of the grid matrix layer 5, in place of niobium or tungsten, the R.I.E. etching of this material can be carried out using an HBr or $Cl_2$ mixture under a vacuum of about 300 mT, after performing a preliminary cleaning step, for example in a He+$O_2$ plasma, and removing the native oxide in a $C_2F_6$ plasma.

The diameter of the grid apertures and of the underlying holes 7 can usually range from 0.5 to 1.5 micrometers, depending on the size of the panel. The walls of the etched wells are substantially vertical, in view of the high anisotropy of the plasma etching process used.

The structure that is obtained in schematically shown in FIG. 9. The structure is substantially similar to the one obtained by the known process, without resorting to the special and burdensome techniques of deposition at a grazing angle of incidence of the lift-off layer 6.

Moreover, the etching that produces the circular apertures 7 through the grid matrix layer 5 and the underlying dielectric layer until exposing the surface of the high resistivity layer 3, takes place after having deposited the lift-off material 6 onto the grid matrix layer 5, thus eliminating any possibility of contaminating the bottom of the holes 7 produced.

After an eventual deposition of one or more layers of "adhesion" or "compatibility" conductive materials, the process of deposition via sputtering at normal incidence, produces a conoidal growth 8 of the deposit within the holes 7 due to the shielding effect of the vertical walls of the well that continues and becomes more and more accentuated with the growing of the deposit 9 onto the surface of the lift-off layer. The growth of the cones 8 eventually terminates with an almost complete occlusion of the correspondent narrowing deposition window through the overstructure 9 resting on the nickel layer 6. This peculiar form of deposit that is produced is schematically illustrated in the cross-section of FIG. 10. The deposition cones 8 that are produced within the wells because of the shielding effect of the surrounding walls are clearly visible. This effect is due to a progressive narrowing of the deposition window that occurs with the growth of the deposition overstructure 9, up to an almost complete occlusion of the opening.

Figure 10:
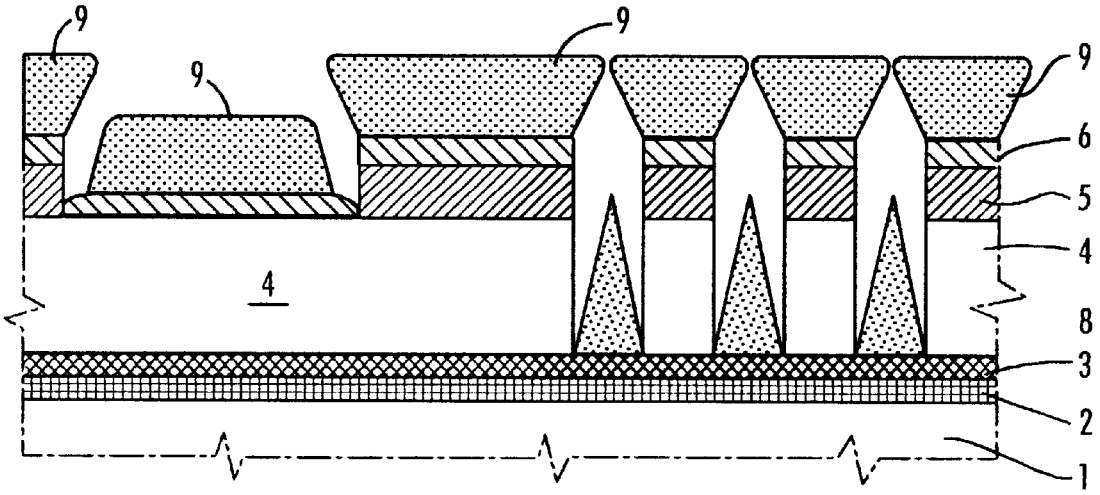

Of course, the diameter of the hole 7, the thickness of the dielectric layer 4 and the thickness of the grid conductor 5, are coordinated among themselves and with the conditions of deposition via sputtering of the molybdenum in wells formed in this stack so that the apex of the deposition cones 8 reach approximately the same level of the grid electrode 5, as shown in FIG. 10.

Removal of the deposition overstructure 9 is carried out by electrochemically etching the lift-off layer of nickel according to the embodiment already described above.

According to an alternative embodiment illustrated in FIGS. 12 to 15, a mask R is formed onto the surface of the conductive matrix layer 5 of the grid structure. The mask R defines the openings that are to be formed through the matrix layer 5 and the isolating dielectric layer 4.

This mask R is photolithographically defined using preferably a negative resist, for example the NFR 020 resist produced by the JSR Company, having enhanced characteristics of thermal stability and the ability to withstand the sputter deposition of the conductive materials forming the microtips, as well as the eventual heat and vacuum treatments normally performed to prevent outgassing phenomena during the deposition of the microtip metal. The etching of the grid matrix layer and of the underlying isolation dielectric layer is carried out through the apertures of the resist mask R, thus producing holes 7, the bottom of which is constituted by the surface of the underlying high resistivity layer 3.

Once the etching is completed, the residual resist of the mask R is not removed, instead, the sputter deposition of a refractory metal, for example molybdenum is carried out. This deposition can optionally be preceded by the deposition of one or more thin compatibility or adhesion layers, for example chromium. The peculiar shape of the molybdenum deposit that is eventually produced is illustrated in a cross-schematic way in the section of FIG. 14. The deposition cones 8 that are produced within the holes 7 by virtue of the shielding effect of the surrounding walls are clearly visible.

The effect is substantially due to a progressive shrinking of the deposition window that occurs with the growing of the deposit 9, until an eventual nearly complete occlusion of the openings occurs. The diameter of the holes 7, the thickness of the dielectric layer 4 and the grid conductor layer 5, and, in this case, also the thickness R of the resist mask, are coordinated among themselves and with the sputtering conditions of the molybdenum, in order to ensure that the apexes of the deposition cones 8 reach almost the same level of the grid electrode 5, as shown in FIG. 15.

According to this alternative embodiment of the invention, the lift-off of the deposition overstructure 9 takes place by leaching off the resist layer R by medium boiling point organic strippers, for example, the EKC 265 solvent, followed by or preceded by a dry etching in an oxygen plasma.

According to a disclosed class of innovative embodiments, there is provided: a process for fabricating a microtip cathode assembly for a field emission display panel, comprising the steps of: (a.) providing a microtip cathode plate comprising a support plate, a first conductive layer deposited over said support plate and patterned to form parallel conductive strips, an isolating dielectric layer deposited over said conductive strips, and a second conductive layer deposited over said isolating dielectric layer; (b.) depositing a layer of lift-off material above said conductive matrix layer, said layer of lift-off material having a thickness substantially smaller than the thickness of said second conductive layer; (c.) patterning and anisotropically etching said layer of lift-off material, said second conductive layer, and said dielectric layer together to form a plurality of holes; (d.) depositing a conductive material to produce a conoidal growth of said conductive material within each of said holes as well as an overstructure resting on said layer of lift-off material; and (e.) wet-etching said layer of lift-off material to remove said overstructure without damaging said conoidal growth.

According to another disclosed class of innovative embodiments, there is provided: a process for fabricating a microtip cathode assembly for a field emission display panel, comprising the steps of: (a.) providing a microtip cathode plate comprising a support plate, a first conductive layer deposited over said support plate, a layer of high-resistivity material deposited over said first conductive layer, said layer of high-resistivity material having a resistivity higher than said first conductive layer, said layer of high-resistivity material and said first conductive layer being patterned to form parallel conductive strips, an isolating dielectric layer deposited over said conductive strips, and a second conductive layer deposited over said isolating dielectric layer; (b.) forming a resist layer having a plurality of apertures over said second conductive layer; (c.) patterning and etching said second conductive layer and said isolating dielectric layer together through said apertures to produce a plurality of holes; (d.) depositing a conductive material to produce a conoidal growth of said conductive material within said holes as well as an overstructure resting on said resist layer; and (e.) etching said resist layer to remove said overstructure without damaging said conoidal growth.

According to another disclosed class of innovative embodiments, there is provided: a process for forming a microtip cathode on a field emission display (FED) panel comprising the following steps: depositing a first conductive layer on a dielectric substrate and optionally depositing thereon at least a layer of a material having a resistivity higher than the first conductive layer; defining by masking and etching parallel strips of said conductive first layer or multilayer, forming a plurality of cathode conductors that constitute the columns of a driving matrix of the display organized in rows and columns; depositing an isolating layer of a dielectric material over the entire surface of the substrate and of said the cathodic conductors defined thereon; depositing at least a second conductive layer above said dielectric layer; patterning by two masking and etching steps said second conductive layer into parallel strips orthogonal to said cathodic conductors and a population of apertures, densely distributed onto the surface of the strips and digging wells through said dielectric layer in coincidence with said circular apertures until exposing covering the surface of said first cathode conductors at the bottom of said wells; depositing by sputtering a conductive material causing the growth of deposition cones on the bottom of each of said wells; removing from the surface the deposited overstructure of said conductive material; characterized in that said deposited overstructure is removed by a lift-off technique using a lift-off layer that is co-defined together with said apertures.

As will be recognized by those skilled in the art, the innovative concepts described in the present application can be modified and varied over a tremendous range of applications, and accordingly the scope of patented subject matter is not limited by any of the specific exemplary teachings given.

What is claimed is:

1. A process for fabricating a microtip cathode assembly for a field emission display panel, comprising the steps of:

(a.) providing a microtip cathode plate comprising a support plate, a first conductive layer formed over said support plate and patterned to form parallel conductive strips defining a plurality of cathodic conductors, an isolating dielectric layer formed over said conductive strips, and a second conductive layer formed over said isolating dielectric layers and patterned to form a plurality of parallel strips orthogonal to the plurality of cathodic conductors defining steps between the plurality of parallel strips;

(b.) depositing by sputtering at a substantially perpendicular incidence with the support plate a layer of lift-off material directly on said second conductive layer, said layer of lift-off material having a thickness substantially smaller than the thickness of said second conductive layer so that lines of discontinuity of the lift-off layer are formed along with the steps between the plurality of parallel strips of the second conductive layer;

(c.) patterning and anisotropically etching said layer of lift-off material, said second conductive layer, and said dielectric layer together to form a plurality of holes;

(d.) depositing a conductive material to produce a conical growth of said conductive material within each of said holes as well as an overstructure resting on said layer of lift-off material; and (e.) wet-etching said layer of lift-off material to remove said overstructure without damaging said conical growth.

2. The process of claim 1, wherein said support plate is glass.

3. The process of claim 1, wherein said layer of lift-off material comprises nickel.

4. The process of claim 1, wherein said support plate is ceramic.

5. The process of claim 1, wherein said microtip cathode plate further comprises an oxide layer deposited over said support plate.

6. The process of claim 1, wherein said first microtip cathode plate further comprises a layer of high-resistivity material deposited over said first conductive layer, said layer of high-resistivity material having a resistivity higher than said conductive layer.

7. The process of claim 1, wherein said isolating dielectric layer comprises silicon dioxide having a thickness between 0.6 μm and 1.3 μm.

8. The process of claim 1, wherein said second conductive layer has a thickness of 0.5 μm.

9. The process of claim 1, wherein said second conductive layer has a thickness between 0.2 μm and 0.7 μm.

10. The process of claim 1, wherein said layer of lift-off material has a thickness between 15 nm and 20 nm.

11. The process of claim 1, wherein the diameter of each of said holes ranges from 0.5 μm to 1.5 μm.

12. The process of claim 1, wherein said conical growth of said conductive material has an apex approximately level with said second conductive layer.

13. The process of claim 1, further comprising the step of: before said step (d.), depositing at least one adhesion layer.

14. A process for fabricating a microtip cathode assembly for a field emission display panel, comprising the steps of:

(a.) providing a microtip cathode plate comprising a support plate, a first conductive layer formed over said support plate, a layer of high-resistivity material formed over said first conductive layer, said layer of high-resistivity material having a resistivity higher than said first conductive layer, said layer of high-resistivity material and said first conductive layer being patterned to form parallel conductive strips defining a plurality of cathodic conductors, an isolating dielectric layer formed over said conductive strips, and a second conductive layer formed over said isolating dielectric layer;

(b.) patterning and etching said second conductive layer to form a plurality of parallel strips orthogonal to the plurality of cathodic conductors defining steps between the plurality of parallel strips;

(c.) depositing a layer of lift-off material directly on said second conductive layer by sputtering at a substantially perpendicular incidence with the support plate, said layer of lift-off material having a thickness substantially smaller than a thickness of said second conductive layer so that lines of discontinuity of the lift-off layer are formed along with the steps between the plurality of parallel strips of the second conductive layer;

(d.) patterning and etching said layer of lift-off material, said second conductive layer and said isolating dielectric layer together through said apertures to produce a plurality of holes;

(e.) depositing a conductive material to produce a conical growth of said conductive material within said holes as well as an overstructure resting on said resist layer; and (f.) etching said layer of lift-off material to remove said overstructure without damaging said conical growth.

15. The process of claim 14, wherein said support plate is glass.

16. The process of claim 14, wherein said support plate is ceramic.

17. The process of claim 14, wherein said microtip cathode plate further comprises an oxide layer deposited over said support plate.

18. The process of claim 14, wherein said step (e.) is performed using an oxygen plasma, and further comprising the step of: before said step (e.), performing a wet-softening of said resist layer.

19. The process of claim 14, wherein said layer of high-resistivity material comprises polycrystalline silicon.

20. The process of claim 14, wherein said isolating dielectric layer comprises silicon dioxide having a thickness between 0.6 μm and 1.3 μm.

21. The process of claim 14, wherein said second conductive layer has a thickness of 0.5 μm.

22. The process of claim 14, wherein said second conductive layer has a thickness between 0.2 μm and 0.7 μm.

23. The process of claim 14, wherein the diameter of each of said holes ranges from 0.5 μm to 1.5 μm.

24. The process of claim 14, wherein said conical growth of said conductive material has an apex approximately level with said second conductive layer.

25. The process of claim 14, further comprising the step of: before said step (d), depositing at least one adhesion layer.

26. The process of claim 14, wherein said conductive material comprises molybdenum.

27. A process for forming a microtip cathode on a field emission display (FED) panel comprising the following steps:

forming a first conductive layer on a dielectric substrate and optionally forming thereon at least a layer of a material having a resistivity higher than said first conductive layer;

defining by masking and etching, parallel strips of said first conductive layer, defining a plurality of cathodic conductors defining columns of a driving matrix of the display organized in rows and columns;

forming an isolating layer of a dielectric material over the entire surface of said substrate and of said cathodic conductors defined thereon;

forming at least a second conductive layer above said dielectric layer;

patterning by two masking and etching steps said second conductive layer into parallel strips orthogonal to said cathodic conductors defining steps between the plurality of parallel strips, and defining a plurality of circular apertures, densely distributed onto the surface of said strips of said second conductive layer and digging wells through said dielectric layer in coincidence with said circular apertures until exposing the surface of said cathodic conductors at the bottom of said wells;

depositing by sputtering a conductive material causing the growth of deposition cones on the bottom of each of said wells;

removing from the surface of said second conductive layer the deposited overstructure of said conductive material;

said deposited overstructure being removed by a lift-off layer deposited by sputtering at a substantially perpendicular incidence with the substrate, the lift-off layer being appliad before defining the plurality of circular apertures, the lift-off layer having a thickness less than a thickness of said second conductive layer so that lines of discontinuity of the lift-off layer are formed along with the steps between the plurality of parallel strips of the second conductive layer.

28. The process according to claim 27, characterized in that said lift-off layer is constituted by a resist layer of the mask through the apertures of which said second conductive layer and said dielectric layer are etched and which is left purposely on the surface of the panel during the subsequent sputter deposition of the cone material.

29. The process according to claim 27, characterized in that said lift-off layer is a nickel layer deposited above said second conductive layer and etched by a wet-etching step and by an ion bombardment step through the openings of said mask for defining said second conductor layer.

30. The process according to claim 27, characterized in that said isolating dielectric layer comprises silicon oxide, said second conductive layer consists of a material belonging to the group composed of niobium, tungsten, chromium, tantalum, doped polycrystalline or amorphous silicon and said material forming the cones belongs to the group composed of molybdenum, tungsten, chromium and tantalum.

31. The process according to claim 30, characterized in that said second conductive layer is a stack of said conductive materials.

32. The process according to claim 27, characterized in that said lift-off layer is metallic and is deposited on said second conductive layer after patterning said second conductive layer into a plurality of parallel strips.

33. The process according to claim 32, characterized in that said lift-off layer consists of nickel and has a thickness ranging from 15 to 20 nm, while said second conductive layer consists of a material belonging to the group composed of tungsten and doped polycrystalline or amorphous silicon, having a thickness ranging from 200 to 700 nm.

34. A process for forming a microtip cathode on a field emission display (FED) panel comprising the steps of:

forming a first conductive layer on a dielectric substrate and optionally forming thereon at least a layer of a material having a resistivity higher tha n said fi rst conduct ive layer;

defining by masking and etching, parallel strips of said first conductive layer, defining a plurality of cathodic conductors that form the columns of a dr iving matrix of the display organized in rows and columns;

forming an isolating layer of a dielectric material over the entire surface of said substrate and of said cathodic conductors defined thereon;

forming at least a second conductive layer above said dielectric layer;

patterning by two masking and etching steps said second conductive layer into parallel strips orthogonal to said cathodic conductors, defining a plurality of circular apertures densely distributed onto the surface of said strips of said second conductive layer and digging wells through said dielectric layer in coincidence with said circular apertures until exposing the surface of said cathodic conductors at the bottom of said wells;

depositing by sputtering a conductive material causing the growth of deposition cones on the bottom of each of said wells; and removing from the surface of said second conductive layer the deposited overstructure of said conductive material;

said deposited overstructure is removed by a lift-off technique using a lift-off layer that is co-defined together with said apertures, and said lift-off layer is a nickel layer deposited above said second conductive layer and etched by a wet-etching step and by an ion bombardment step through the openings of said mask for defining said second conductor layer.

35. The process according to claim 34, wherein said lift-off layer is formed by a resist layer of the mask through the apertures of which said second conductive layer and said dielectric layer are etched and which is left purposely on the surface of the panel during the subsequent sputter deposition of the cone material.

36. The process according to claim 34, wherein said isolating dielectric layer comprises silicon oxide, said second conductive layer comprises a material belonging to the group composed of niobium, tungsten, chromium, tantalum, doped polycrystalline or amorphous silicon and said material forming the cones belongs to the group of molybdenum, tungsten, chromium and tantalum.

37. The process according to claim 36, wherein said second conductive layer is a stack of said conductive materials.

38. The process according to claim 34, wherein said lift-off layer is metallic and has a thickness less than the thickness of said second conductive layer and is deposited thereon after patterning said second conductive layer into a plurality of parallel strips and before defining said apertures.

39. The process according to claim 38, wherein said lift-off layer comprises nickel and has a thickness ranging from 15 to 20 nm, while said second conductive layer comprises a material belonging to the group composed of tungsten and doped polycrystalline or amorphous silicon, having a thickness ranging from 200 to 700 nm.

* * * * *

UNITED STATES PATENT AND TRADEMARK OFFICE

CERTIFICATE OF CORRECTION

PATENT NO. : 6,000,980
DATED : December 14, 2000
INVENTOR(S) : Livio Baldi, Alessandro Tonti It is certified that error appears in the above-identified patent and that said Letters Patent is hereby corrected as shown below:

| | |
|---|---|
| Column 7, line 58 | Strike ")" |
| Column 9, Line 66 | Strike: "in"<br>Insert: - -is- - |
| Column 12, line 35 | Strike: "layers"<br>Insert: - -layer- - |
| Column 14, line 58 | Strike: "appliad"<br>Insert: - -applied- - |
| Column 15, line 32 | Strike: "tha n"<br>Insert: - -than- - |
| | Strike: "fi rst"<br>Insert: - -first- - |
| Column 15, line 33 | Strike: "conduct ive"<br>Insert: - -conductive- - |

UNITED STATES PATENT AND TRADEMARK OFFICE

CERTIFICATE OF CORRECTION

PATENT NO. : 6,000,980

DATED : December 14, 2000

INVENTOR(S) : Livio Baldi, Alessandro Tonti

It is certified that error appears in the above-identified patent and that said Letters Patent is hereby corrected as shown below:

Column 15, line 36 — Strike: "dr iving"
Insert: "driving"

Figure 11:
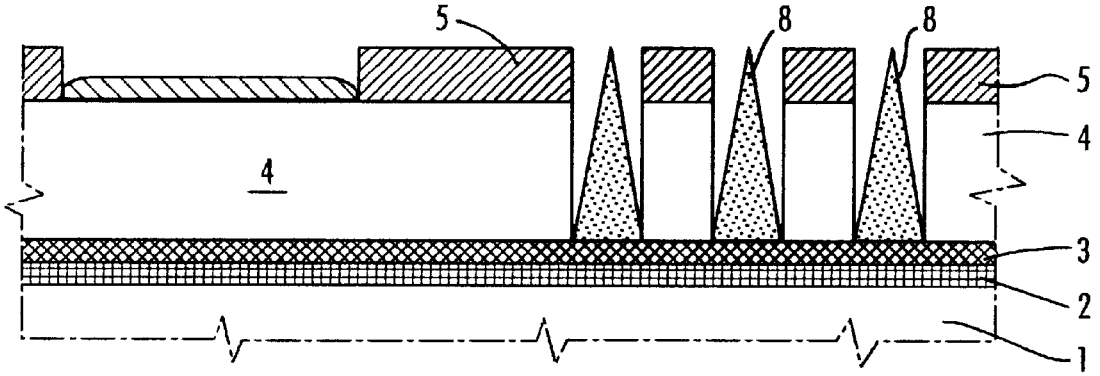

Figure 11 — Strike Figure 11:
Insert:

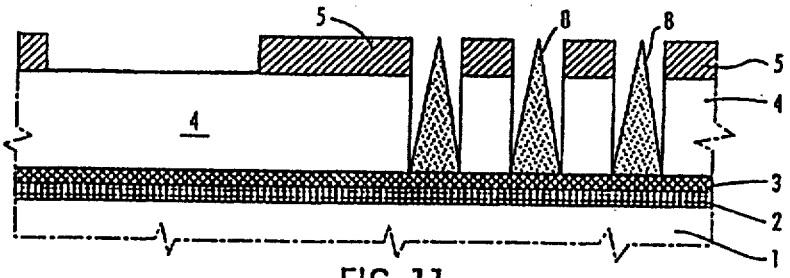

FIG. 11

Signed and Sealed this

Twenty-sixth Day of September, 2000

*Attest:*

Q. TODD DICKINSON

*Attesting Officer*

*Director of Patents and Trademarks*